US012110155B2

(12) United States Patent
Guirguis

(10) Patent No.: US 12,110,155 B2
(45) Date of Patent: Oct. 8, 2024

(54) TAMPER EVIDENT CONTAINER

(71) Applicant: Pianca Packaging LLC, Englishtown, NJ (US)

(72) Inventor: Sameh Guirguis, Old Bridge, NJ (US)

(73) Assignee: PIANCA PACKAGING LLC., Whitehall, PA (US)

( * ) Notice: Subject to any disclaimer, the term of this patent is extended or adjusted under 35 U.S.C. 154(b) by 0 days.

(21) Appl. No.: 17/984,857

(22) Filed: Nov. 10, 2022

(65) Prior Publication Data

US 2023/0067459 A1 Mar. 2, 2023

Related U.S. Application Data

(63) Continuation-in-part of application No. 16/945,672, filed on Jul. 31, 2020, now Pat. No. 11,498,732, which is a continuation-in-part of application No. 16/752,109, filed on Jan. 24, 2020, now Pat. No. 11,628,981.

(51) Int. Cl.
*B65D 43/02* (2006.01)

(52) U.S. Cl.
CPC ..... *B65D 43/0237* (2013.01); *B65D 2401/60* (2020.05)

(58) Field of Classification Search
CPC ..... B65D 17/00; B65D 55/06; B65D 43/162; B65D 55/024; B65D 2401/60
See application file for complete search history.

(56) References Cited

U.S. PATENT DOCUMENTS

| | | | | |
|---|---|---|---|---|
| 2,941,660 A * | 6/1960 | Tupper | B65D 43/0274 229/233 |
| 5,788,105 A * | 8/1998 | Foos | B65D 75/22 206/469 |
| 2005/0184070 A1* | 8/2005 | Boback | B65D 43/021 220/270 |
| 2019/0144171 A1* | 5/2019 | Schoen | B65D 43/162 220/266 |

* cited by examiner

*Primary Examiner* — Jeffrey R Allen
(74) *Attorney, Agent, or Firm* — Ziegler IP Law Group

(57) ABSTRACT

A tamper evident container includes a cover comprising a first interlocking flange with a first inner tab and a first outer tab separated by a first severable line and a base comprising a second interlocking flange with a second inner tab and a second outer tab separated by second severable line, where the first and second interlocking flanges are configured to be fastened together and the container is configured to be opened by separating the first and second inner tabs from the respective first and second outer tabs while one of the first and second outer tabs remains attached to the container and another of the first and second outer tabs is separated from the container and remains attached to the one of the first and second outer tabs.

20 Claims, 11 Drawing Sheets

SLICE SECTION C-C

SLICE SECTION B-B

TAMPER EVIDENT CONTAINER

CROSS REFERENCE TO RELATED APPLICATIONS

This application is Continuation in Part of U.S. patent application Ser. No. 16/945,672, titled "Temper Evident Container," filed on 31 Jul. 2020, which is a Continuation in Part of U.S. patent application Ser. No. 16/752,109, titled "Temper Evident Container," filed on 24 Jan. 2020, all of which are incorporated by reference in their entirety.

FIELD

The present disclosure relates generally to packaging and in particular to packaging that provides a clear indication in the event of tampering.

BACKGROUND

Various consumer products are typically packaged in containers. Generally, the consumer desires that the containers remain intact in order to preserve the value of the goods contained therein. Proving evidence of container tampering, or evidence that the container has previously been opened, would be advantageous in maintaining the quality and value of the packaged goods.

SUMMARY

In at least one aspect, the disclosed embodiments are directed to a tamper evident container including a cover comprising a first interlocking flange with a first inner tab and a first outer tab separated by a first severable line and a base comprising a second interlocking flange with a second inner tab and a second outer tab separated by second severable line, where the first and second interlocking flanges are configured to be fastened together and the container is configured to be opened by separating the first and second inner tabs from the respective first and second outer tabs while one of the first and second outer tabs remains attached to the container and another of the first and second outer tabs is separated from the container and remains attached to the one of the first and second outer tabs.

The second outer tab may be attached to the base of the container and the first outer tab may be attached to the second outer tab.

The second outer tab may be attached to the base of the container on one side of the second outer tab.

The second outer tab may be attached to the base of the container on two sides of the second outer tab.

The first outer tab may be attached to the cover of the container and second outer tab is attached to the first outer tab.

The first outer tab may be attached to the cover of the container on one side of the first outer tab.

The first outer tab may be attached to the cover of the container on two sides of the first outer tab.

The tamper evident container may include a hinge connecting the cover and the base.

The cover and base may include comprise one or more of molded pulp fiber, high density polyethylene, polyethylene terephthalate, polystyrene, or polypropylene.

In at least one other aspect, the disclosed embodiments are directed to a method of providing a tamper evident container including forming a cover comprising a first interlocking flange with a first inner tab and a first outer tab separated by a first severable line, and forming a base comprising a second interlocking flange with a second inner tab and a second outer tab separated by second severable line, where the first and second interlocking flanges may be fastened together and the container may be opened by separating the first and second inner tabs from the respective first and second outer tabs while one of the first and second outer tabs remains attached to the container and another of the first and second outer tabs is separated from the container and remains attached to the one of the first and second outer tabs.

DETAILED DESCRIPTION

The disclosed embodiments are directed to providing a tamper evident container with tabs that are inaccessible until a locking mechanism is removed.

Figure 1:
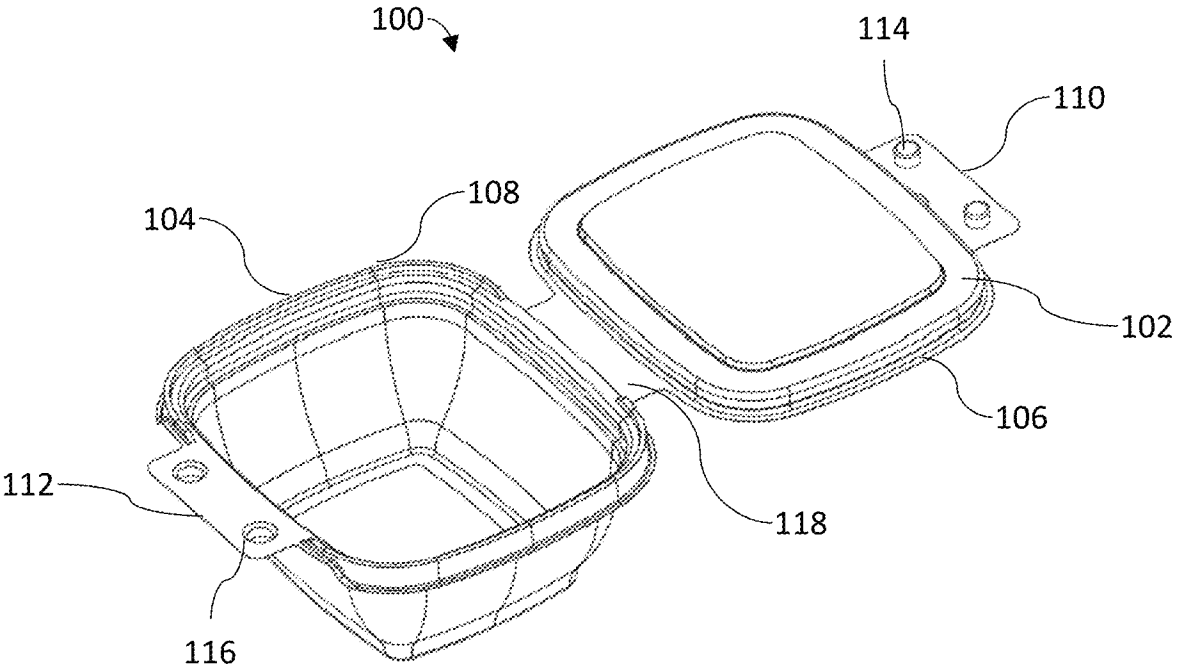
FIG. 1 shows a perspective view of an open container according to an aspect of the disclosed embodiments.

FIG. 1 shows a perspective view of a container 100 according to the disclosed embodiments. While the container 100 may be illustrated as rectangular in shape, with curved corners, it should be understood that the container 100 may be square, round, oval, or may have any appropriate shape. The container 100 may be formed from general packaging materials, for example, one or more of polyethylene terephthalate, polystyrene, polypropylene, or molded pulp fiber, however it should be understood that the container may be constructed of any material or combination of materials suitable for providing the features of the container 100 as described herein. The container 100 may include a cover 102 and a base 104. The cover may have a peripheral edge 106 that may rest on an upper portion 108 of the base 104 when the container 100 is closed. The cover 102 and base 104 may be patterned with one or more indented or raised areas, channels, grooves, or other features that may provide structural integrity or stiffness, or a stacking feature to the container 100. The cover 102 and base 104 may also be imprinted with indicia, for example, trademarks, barcodes, or text, and may be constructed of material that is transparent, translucent, or has color.

The cover 102 and base 104 may further include respective first and second interlocking flanges 110, 112 with tabs that extend outward and with complementary frangible locking elements 114, 116. In some embodiments the cover 102 and base 104 may be connected by a hinge 118, while in other embodiments the cover 102 and base 104 may be implemented as separate pieces. In embodiments where the cover 102 and base 104 are implemented as separate pieces, the cover 102 and base 104 may have interlocking flanges on opposing sides with frangible locking elements.

Figure 2B:
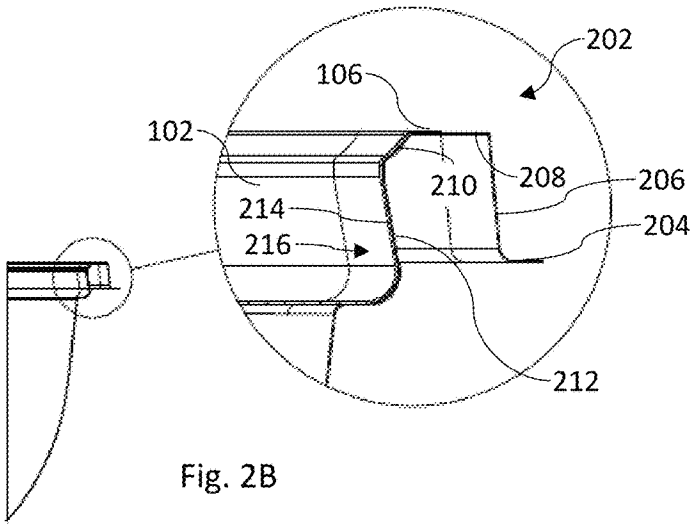
FIG. 2B shows a cross section of the rim.
Figure 2D:
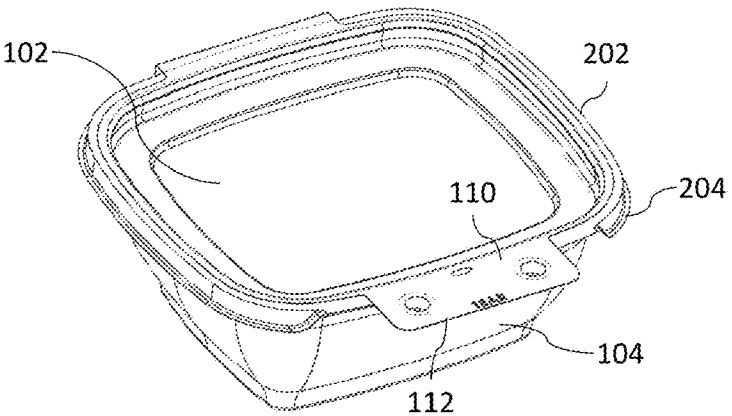
FIG. 2D illustrates the rim in place on a closed container.
Figure 2A:
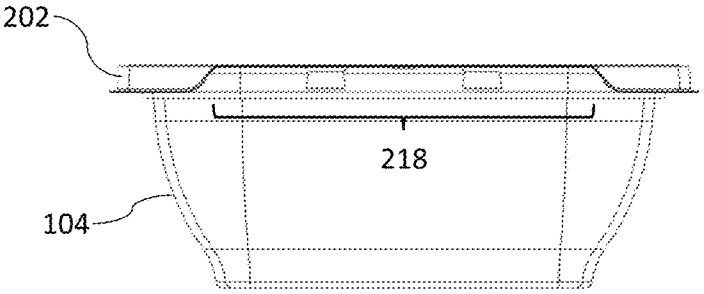
FIG. 2A shows a front view of a container base with a rim.

FIG. 2A shows a front view of the base 104. The base 104 may include an inverted U-shaped rim 202 that extends substantially around the perimeter of an upper section of the base 104. FIG. 2B shows a cross section of the rim 202 illustrating a flange portion 204, an outer wall portion 206, a flat top portion 208, a curved lead in recess 210 extending inward from the flat top portion 208 and a lower recess 212 extending from the lead in recess 206 to the body of the base 104. The peripheral edge 106 of the cover 102 may rest on or contact a part of the flat top portion 208 when the cover 102 is closed. As a result, the peripheral edge 106 of the cover 102 is rendered relatively inaccessible because the flat top portion 208 extends beyond the peripheral edge 106. When the cover 102 is closed, a rib portion 214 of the cover 102 may contact the lower recess 212 to form a leak resistant press fit seal 216. Returning to FIG. 2A, the outer wall portion 206 of the rim 202 may have a raised area 218 through which the second interlocking flange 112 extends from the flat top portion 208.

Figure 2C:
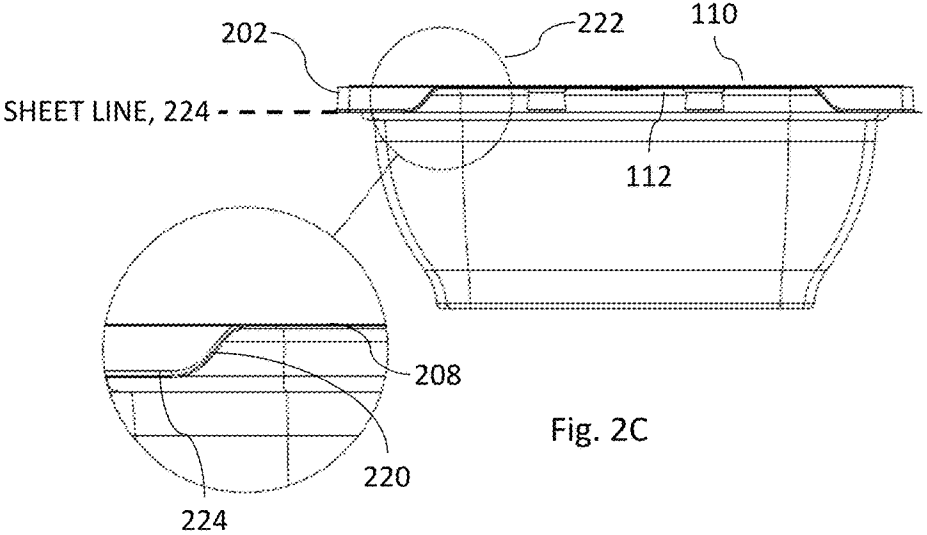
FIG. 2C shows an expanded view of a raised area of the rim.

FIG. 2C shows an expanded view of the raised area 218 of the rim including a ramp 220 positioned at sides 222 of the raised area 218, applicable to the disclosed embodiments. As shown in the expanded view, the sides 222 of the raised area 218 have a ramp 220 extending upward from a lower edge of a sheet line 224 of the rim 202 to the flat top portion 208. The profile of the rim 202 with the ramp 220 extending from a sheet line 224 starting at the flange portion 204 to the flat top portion 208 may be implemented using three dimensional (3D) trim techniques versus conventional two dimensional (2D) trim techniques that may trim the finished container at only the sheet line 224.

The raised area 218 and the position of the flat top portion 208 operates to cause the first and second interlocking flanges 110, 112 to abut, one over the other, with little or no space in between, when the cover 102 is closed over the base 104 as shown in FIG. 2D. When the cover 102 is closed, the first interlocking flange 110 rests on the top flat portion 208 of the rim 202 and extends through the space between the sides 222 of the raised area 220. Correspondingly, the second interlocking flange extends from the top flat portion 208 through the raised area 218, effecting the abutment of the first and second interlocking flanges 110, 112, one over the other, with little or no space in between. While the interlocking flanges 110, 112 in this embodiment are shown as positioned along a side of the container, it should be clear that the interlocking flanges 110, 112 may be located at any location along the perimeter of the container, for example, at a corner of the container.

Figure 3B:
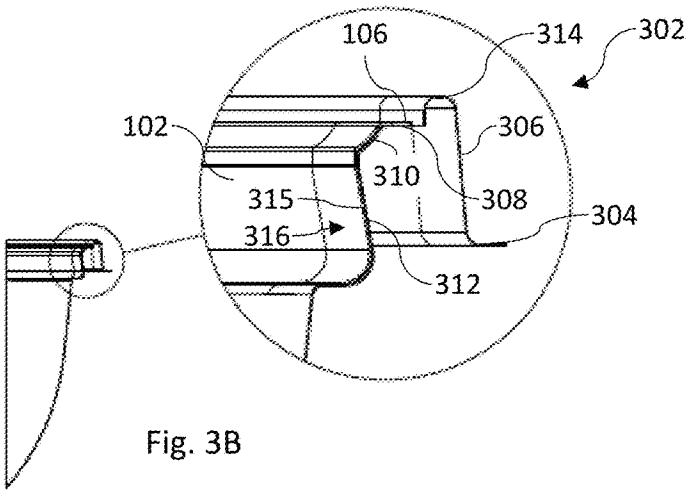
FIG. 3B shows a cross section of the alternate embodiment of the rim.
Figure 3D:
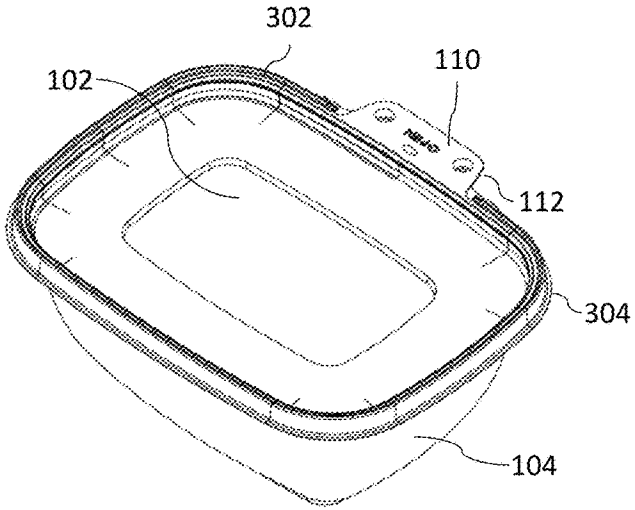
FIG. 3D illustrates the alternate embodiment of the rim in place on a closed container.
Figure 3A:
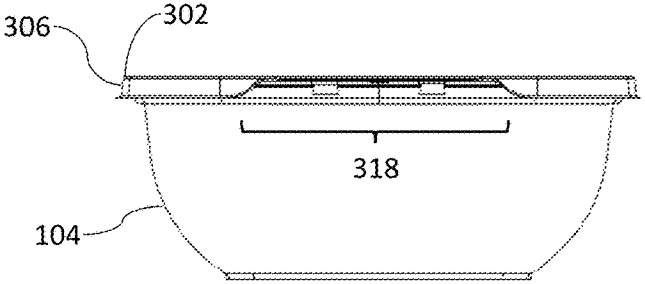
FIG. 3A shows a front view of a container base with an alternate embodiment of the rim.

FIG. 3A shows a front view of the base 104 with an alternate embodiment of the rim 302. As shown in the cross sectional view of FIG. 3B, the rim 302 includes a flange portion 304, an outer wall portion 306, a flat top portion 308, a curved lead in recess 310 extending inward from the flat top portion 308, a lower recess 312 extending from the lead in recess 310 to the body of the base 104, and a bead 314 extending upward and outward from the flat top portion 308. The peripheral edge 106 of the cover 102 may rest on or contact a part of the flat top portion 308 when the cover 102 is closed When the cover 102 is closed, a rib portion 315 of the cover 102 may contact the lower recess 312 to form a leak resistant press fit seal 316. In some embodiments of the rim 302, the bead 314 extending upward and outward from the flat top portion 308 may block access to the peripheral edge 106 edge of the cover 102 when the cover 102 is closed. The peripheral edge 106 of the cover 102 may generally be rendered even more inaccessible by the presence of the bead 314. In additional embodiments, the peripheral edge 106 of the cover 102 may extend toward and may contact the bead 314 proximate a junction of the flat top portion 308 and the bead 314. Returning to FIG. 3A, the outer wall portion 306 of the rim 302 may have a raised area 318 through which the second interlocking flange 112 extends from the flat top portion 308.

Figure 3C:
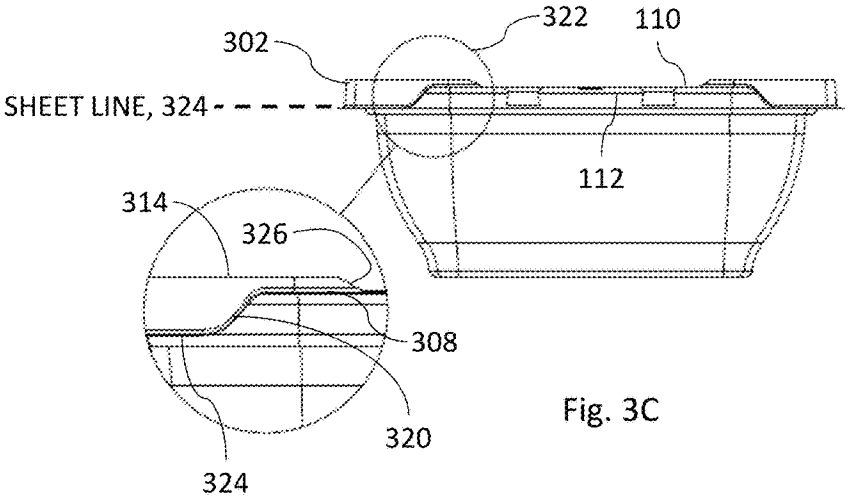
FIG. 3C shows an expanded view of a raised area of the alternate embodiment of the rim.

FIG. 3C shows an expanded view of a ramp 320 positioned at sides 322 of the raised area 318 of the outer wall portion 306 of the rim 302 applicable to the disclosed embodiments. As shown in the expanded view, the sides of the raised area 318 have a ramp 320 extending upward from a lower edge of a sheet line 324 of the rim 302, to the flat top portion 308, and an upper relief 326 extending downward from the bead 314 of the rim 302 to the flat top portion 308. The profile of the rim 302 with the ramp 320 extending from the sheet line 324 to the flat top portion 308 may be implemented using 3D trim techniques versus conventional 2D trim techniques that may trim the finished container at only the sheet line 324.

The raised area 318 and the position of the flat top portion 308 operate to cause the first and second interlocking flanges 110, 112 to abut, one over the other, with little or no space in between, when the cover 102 is closed over the base 104 as shown in FIG. 3D. When the cover 102 is closed, the first interlocking flange 110 rests on the top flat portion 308 of the rim and extends through the space between upper relief 326 on both sides of the raised area 318. Correspondingly, the second interlocking flange extends from the top flat portion 308 through the raised area 318, effecting the abutment of the first and second interlocking flanges 110, 112, one over the other, with little or no space in between.

The interlocking flanges 110, 112 may be located at any location along the perimeter of the container, for example, along any side or at any corner of the container.

Figure 4B:
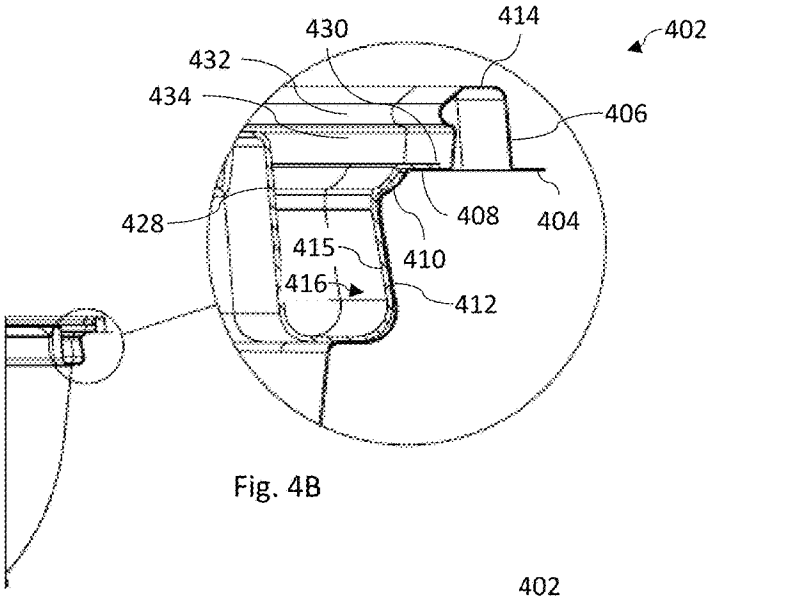
FIG. 4B shows a cross section of the additional alternate embodiment of the rim.
Figure 4D:
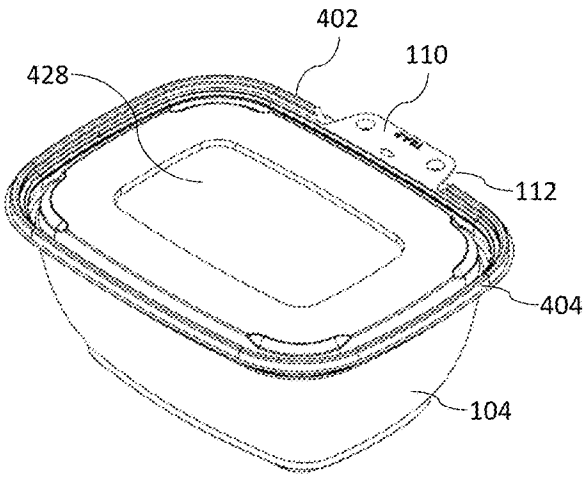
FIG. 4D illustrates the additional alternate embodiment of the rim in place on a closed container.
Figure 4A:
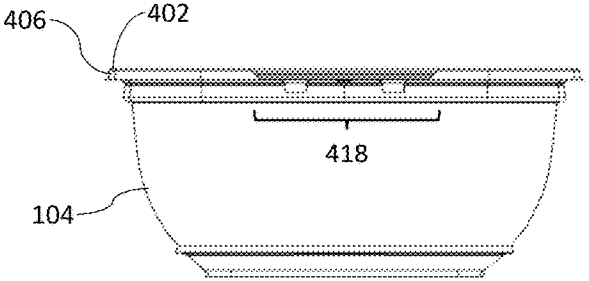
FIG. 4A shows a front view of a container base with yet another alternate embodiment of the rim.

FIG. 4A shows a front view of the base 104 with yet another alternate embodiment of the rim 402 and the cover 428. As shown in the cross sectional view of FIG. 4B, the rim 402 includes a flat portion 408 connected to an outer wall portion 406, by way of a bead 414 extending upward and outward from the flat portion 408, the bead having an undercut 434 and an inward protrusion 432. The rim 402 may also include a flange portion 404 extending from the outer wall portion, a curved lead in recess 410 extending inward from the flat portion 408, and a lower recess 412 extending from the lead in recess 410 to the body of the base 104. In this embodiment, the position of the flange portion 404 and the flat portion 408 correspond to a sheet line 424. A peripheral edge 430 of the cover 428 may rest on or contact a part of the flat portion 408 when the cover 428 is closed. When the cover 428 is closed, a rib portion 415 of the cover 428 may contact the lower recess 412 to form a leak resistant press fit seal 416.

In some embodiments of the rim 402, the bead 414 extending upward and outward from the flat portion 408 may block access to the peripheral edge 430 of the cover 428 when the cover 428 is closed. The peripheral edge 430 of the cover 428 may generally be rendered even more inaccessible by the presence of the inward protrusion 432 of the bead 414 with the undercut 434. In additional embodiments, the peripheral edge 430 of the cover 428 may extend toward and may contact the bead 414 proximate a junction of the flat portion 408 and the bead 414. Returning to FIG. 4A, the outer wall portion 406 of the rim 302 may have a relief 418 through which the second interlocking flange 112 extends from the flat portion 408.

Figure 4C:
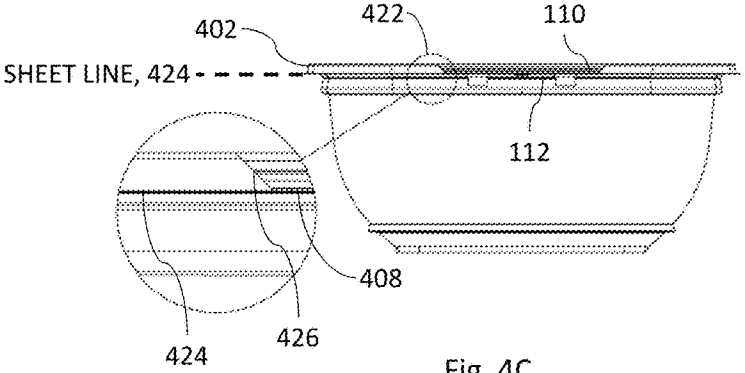
FIG. 4C shows an expanded view of a raised area of the additional alternate embodiment of the rim.

FIG. 4C shows an expanded view of an upper relief 426 positioned at sides 422 of the relief 418 of the outer wall portion 406 of the rim 402 applicable to the disclosed embodiments. As shown in the expanded view, the sides of the relief 418 have an upper relief 426 extending upward from an edge of the rim 402 at a sheet line 424, to the bead 414 of the rim 402.

The profile of the rim 402 with the upper relief 426 may be implemented using conventional 2D trim techniques and advantageously avoids using 3D trim techniques. As a result, this disclosed embodiment is easier and less expensive to produce.

The relief 418 and the position of the flat portion 408 operate to cause the first and second interlocking flanges 110, 112 to abut, one over the other, with little or no space in between, when the cover 102 is closed over the base 104 as shown in FIG. 4D. When the cover 102 is closed, the first interlocking flange 110 rests on the top portion 408 of the rim 402 and extends through the space between the upper relief 426 on both sides of the relief 418. Correspondingly, the second interlocking flange extends from the top portion 408 through the relief 418, effecting the abutment of the first and second interlocking flanges 110, 112, one over the other, with little or no space in between.

The relief 418 and the position of the flat portion 408 operate to cause the first and second interlocking flanges 110, 112 to abut, one over the other, with little or no space in between, when the cover 102 is closed over the base 104 as shown in FIG. 4D. When the cover 102 is closed, the first interlocking flange 110 rests on the flat portion 408 of the rim and extends through the space between the upper relief 426 on both sides of the relief 418. Correspondingly, the second interlocking flange extends from the top portion 408 through the relief 418, effecting the abutment of the first and second interlocking flanges 110, 112, one over the other, with little or no space in between.

Figure 4E:
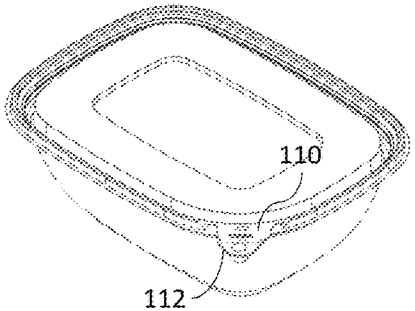
FIG. 4E illustrates another embodiment of a container with interlocking flanges of FIG. 4D in an alternate location.

FIG. 4E illustrates another embodiment of a container with interlocking flanges 110, 112 of FIG. 4D in an alternate location, for example in a corner of the container. However, it should be understood that the interlocking flanges 110, 112 may be located at any location along the perimeter of the container.

Figure 5:
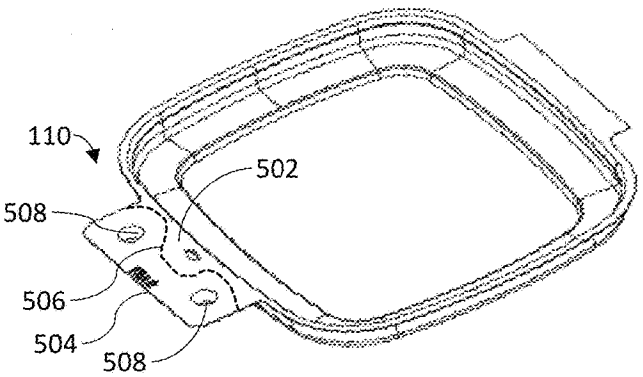
FIG. 5 depicts features of an interlocking flange on a cover of the container.

FIG. 5 depicts features of the first interlocking flange 110 of the cover 102. The first interlocking flange 110 includes a first tab 502 and a first extension 504 joined to the first tab 502 along a first score line 506. The first score line 506 may be in the form of a series of perforations that may separate upon the application of force. The first extension 504 includes first interlocking elements 508.

Figure 6:
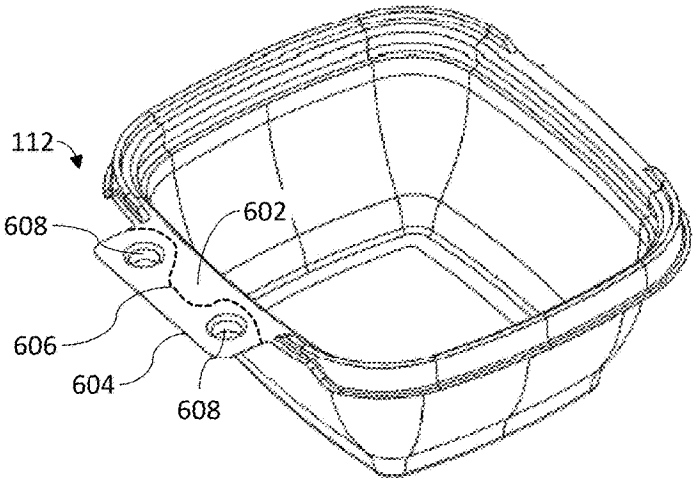
FIG. 6 depicts features of an interlocking flange on a base of the container.

FIG. 6 depicts features of the second interlocking flange 112 of the base 104. The second interlocking flange 112 includes a second tab 602 and a second extension 604 joined to the second tab 602 along a second score line 606. The second score line may also be in the form of a series of perforations that may separate upon the application of force. The second extension 604 includes second interlocking elements 608. When the first and second extensions 504, 604, are separated from the first and second tabs 502, 602, the first and second tabs 502, 602 remain attached to the cover 102 and the base 104, respectively, and may be used to open and optionally close the container.

The interlocking elements 508, 608 while shown as cylindrical, may have any shape that may allow the interlocking elements 508, 608 to securely fasten together. In some embodiments first interlocking elements 508 may be male interlocking elements extending downward, while second interlocking elements 608 may be female interlocking elements with receptacles capable of receiving male interlocking elements, while in other embodiments, the first interlocking elements 508 may be female interlocking elements and the second interlocking elements 608 may be male interlocking elements. In still other embodiments, the first interlocking elements 508 may include a female interlocking element and a male interlocking element and the second interlocking elements 608 may include a corresponding male interlocking element and a female interlocking element. The first and second interlocking elements may have an interference fit, or any other suitable fit, that when securely fastened together, requires more force to separate than to sever the first and second extensions 504, 604 along the first and second score lines 506, 606.

Figure 7:
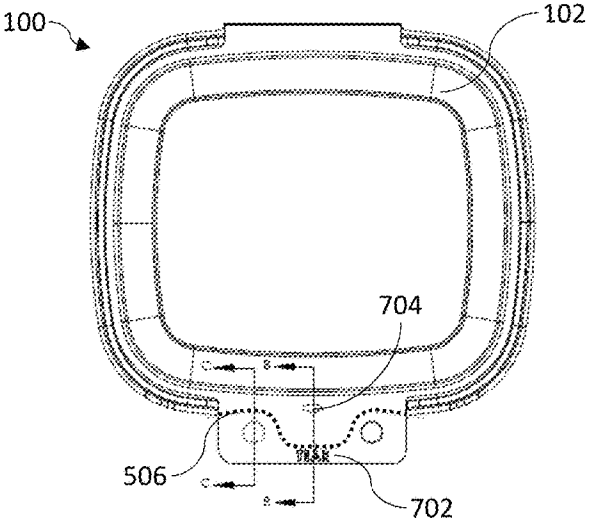
FIG. 7 shows top and partial cross sectional views of a container with interlocking elements securely fastened together.
Figure 7:
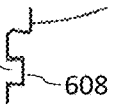
Figure 7:
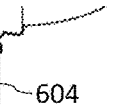

FIG. 7 shows top and partial cross sectional views of the container 100 with the first and second extensions 504, 604 fastened together by way of fastening the interlocking elements 508, 608 securely together. When the first and second extensions 504, 604 are securely fastened together, the first interlocking flange 110 rests on the top flat portion 208, 308 of the rim and extends through the space between the sides of the raised area 218, 318. Also when the extensions 504, 604 are securely fastened together, the second interlocking flange extends from the top flat portion 208, 308 through the raised area 218, 318, and the first and second interlocking flanges 110, 112, abut each other, one over the other, with little or no space in between making access to the locking flanges to separate them apart relatively difficult, preventing access to the tabs 502, 602, and preventing the opening of the container and any tampering with the contents without removing the locking elements.

The first interlocking flange 110 may include an indication 602 as to where to apply force to the securely fastened first and second extensions 504, 604 for removing the first and second extensions 504, 604. Because the force required to separate the interlocking elements 110, 112 is greater than a force that severs the first and second extensions 504, 604 along the score lines 506, 606, the securely fastened first and second extensions 504, 604 will separate along the score lines 506, 606 as a unit from the first and second tabs 502, 602 to clearly provide an indication that the container 100 has been opened, or at least an attempt has been made to open the container 100. One or both of the first and second tabs 502, 602 may have a protrusion 604 that may hold the interlocking flanges 110, 112 apart to facilitate finger access to open the container when the securely fastened first and second extensions 504, 604 have been separated along the score lines 506, 606 as a unit from the first and second tabs 502, 602.

In some embodiments, the cover 102 and base 104 may be configured such that they may be repetitively mated by closing the cover 102 over the base 104 such that the rib portion 214, 315 contacts the lower recess 212, 312 to form the leak resistant press fit seal 216, 316 without securely fastening the interlocking elements 508, 608 together. This may allow the container 100 to be repetitively filled and closed, for example with different foodstuffs, and then securely closing the container 100 by securely fastening the interlocking elements 508, 608 together, hereby activating the tamper evident features, when the filling operations are complete.

Figure 8B:
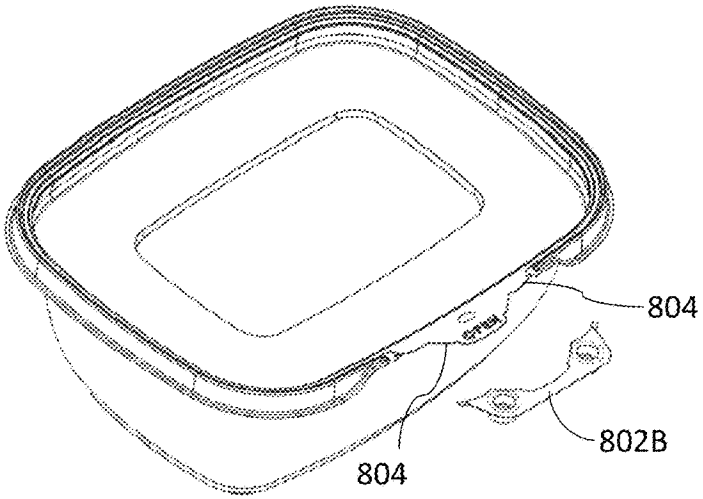
FIG. 8B shows securely fastened interlocking flanges separated as a unit from a container embodiment having no hinge.
Figure 8A:
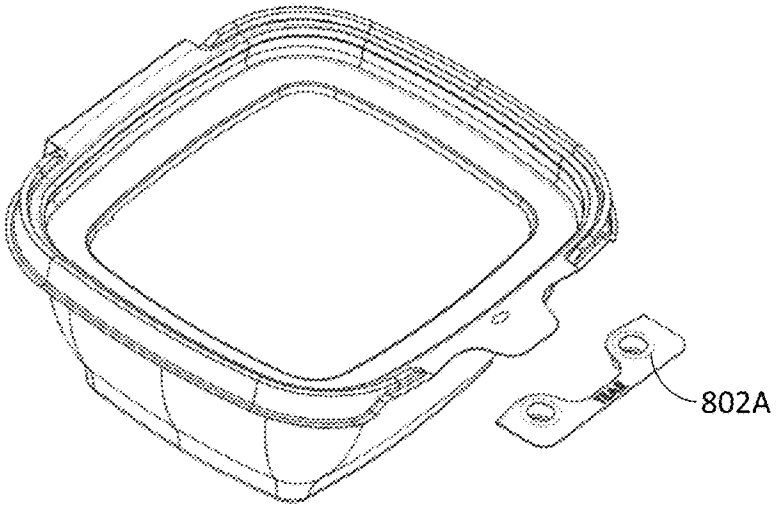
FIG. 8A shows securely fastened interlocking flanges separated as a unit from a container embodiment having a hinge.

FIG. 8A shows the securely fastened extensions 504, 604 separated as a unit 802A from an embodiment of the container 100 having a hinge, while FIG. 8B shows the securely fastened extensions 504, 604 separated as a unit 802B from an embodiment of the container 100 having no hinge where the cover 102 and base 104 are implemented as separate pieces. Also, as shown in FIG. 8B, the score lines 506, 606 may include irregularities that result in outcroppings, projections, or other indications 804 that show evidence of missing extensions 504, 604.

Figure 9B:
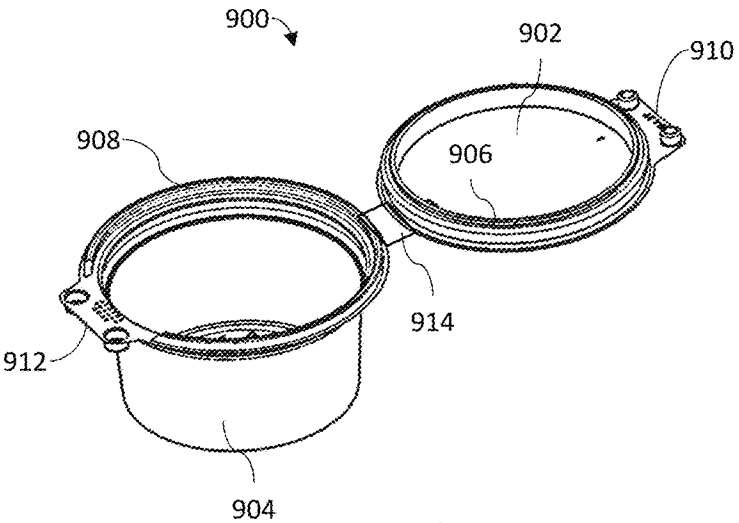
FIG. 9A shows a side view and FIG. 9B shows a perspective view of another container according to the disclosed embodiments.
Figure 9A:
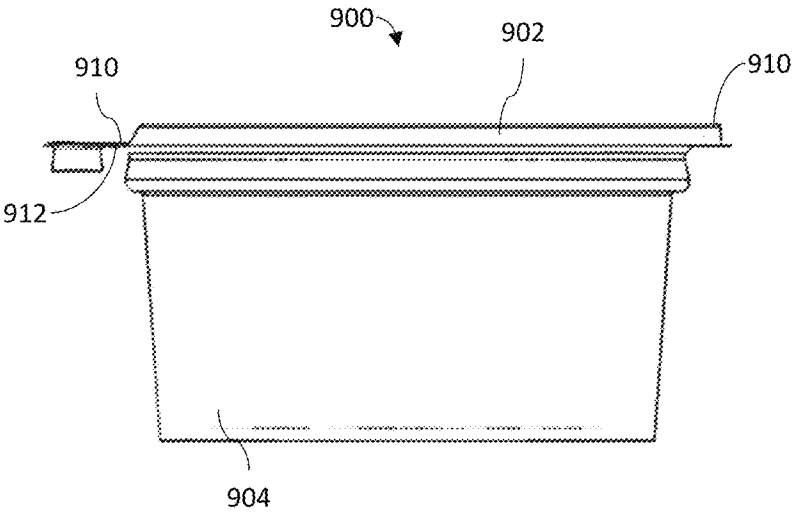

FIG. 9A shows a side view and FIG. 9B shows a perspective view of a container 900 according to the disclosed embodiments that provides for retention of the interlocking flanges to, for example, avoid scattering of loose portions of the packaging and allow recycling all the packaging material. While the container 900 may be illustrated as cylindrical in shape, it should be understood that the container 900 may be square, round, oval, or may have any appropriate shape. The container 900 may be formed from general packaging materials, for example, one or more of polyethylene terephthalate, polystyrene, polypropylene, or molded pulp fiber, however it should be understood that the container may be constructed of any material or combination of materials suitable for providing the features of the container 900 as described herein. The container 900 may include a cover 902 and a base 904. The cover may have a peripheral edge 906 that may rest on an upper portion 908 of the base 904 when the container 900 is closed. The base 904 may include an inverted U-shaped rim 910 that may extend substantially around the perimeter of an upper section of the base 904.

The cover 902 and base 904 may be patterned with one or more indented or raised areas, channels, grooves, or other features that may provide structural integrity or stiffness, or a stacking feature to the container 900. The cover 902 and base 904 may also be imprinted with indicia, for example, trademarks, barcodes, or text, and may be constructed of material that is transparent, translucent, or has color.

Figure 10:
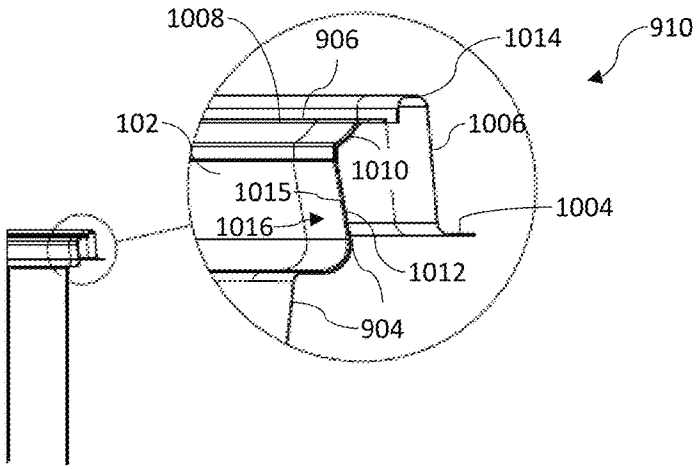
FIG. 10 illustrates a cross sectional view of a rim of the container.

As shown in the cross sectional view of FIG. 10, the rim 910 includes a flange portion 1004, an outer wall portion 1006, a flat top portion 1008, a curved lead in recess 1010 extending inward from the flat top portion 1008, a lower recess 1012 extending from the lead in recess 1010 to the body of the base 904, and a bead 1014 extending upward and outward from the flat top portion 1008. The peripheral edge 906 of the cover 902 may rest on or contact a part of the flat top portion 1008 when the cover 902 is closed. When the cover 902 is closed, a rib portion 1015 of the cover 902 may contact the lower recess 1012 to form a leak resistant press fit seal 1016. According to the disclosed embodiments, the bead 1014 extending upward and outward from the flat top portion 1008 may block access to the peripheral edge 906 edge of the cover 902 when the cover 902 is closed. The peripheral edge 906 of the cover 902 may generally be rendered even more inaccessible by the presence of the bead 1014. In additional embodiments, the peripheral edge 906 of the cover 902 may extend toward and may contact the bead 1014 proximate a junction of the flat top portion 1008 and the bead 1014.

Returning to FIG. 9B, the cover 902 and base 904 may further include respective first and second interlocking flanges 910, 912. In some embodiments the cover 902 and base 904 may be connected by a hinge 914, while in other embodiments the cover 902 and base 904 may be implemented as separate pieces. In embodiments where the cover 902 and base 904 are implemented as separate pieces, the cover 902 and base 904 may have a plurality of interlocking flanges. Some embodiments may include interlocking flanges on opposing sides of the container 900.

According to the disclosed embodiments, the cover 902 includes the first interlocking flange 910 with a first inner tab and a first outer tab separated by a first severable line. The base 904 may include the second interlocking flange 912 with a second inner tab and a second outer tab separated by second severable line, wherein the first and second interlocking flanges are fastened together and the container is opened by separating the first and second inner tabs from the respective first and second outer tabs while one of the second outer tabs remains attached to the container and the other outer tab is separated from the container and remains attached to the one of the second outer tabs.

Figure 11B:
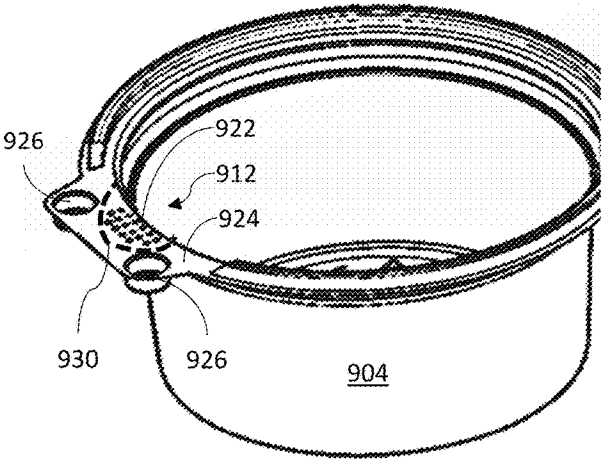
FIG. 11B depicts a second interlocking flange with a second inner tab and a second outer tab.
Figure 11A:
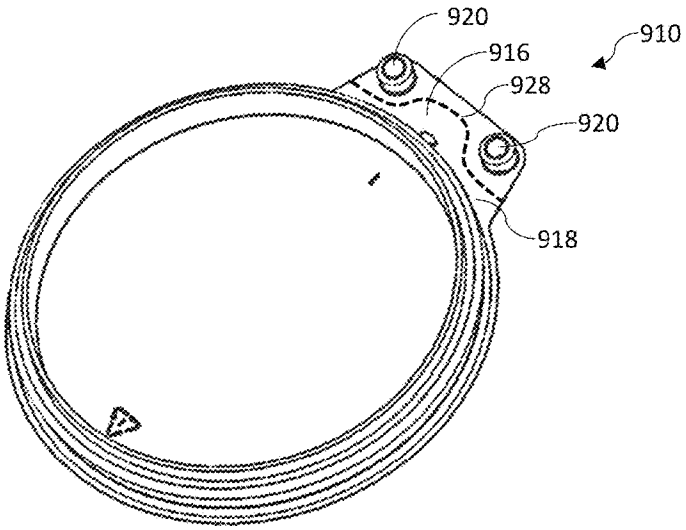
FIG. 11A depicts a first interlocking flange with a first inner tab and a first outer tab with one or more male interlocking elements.

Turning to FIG. 11A, the first interlocking flange 910 may include a first inner tab 916 and a first outer tab 918 with one or more male interlocking elements 920. As shown in FIG. 11B, the second interlocking flange 912 may include a second inner tab 922 and a second outer tab 924 with one or more female interlocking elements 926. According to the disclosed embodiments, the first and second inner tabs 916, 922 may be used to open the container 900 when separated from the respective first and second outer tabs 918, 924.

The first inner tab 916 may be separated from the first outer tab 918 by a perforation, a score line, a reduced thickness portion, a weakened portion, or otherwise first severable line 928 that allows separation of the first inner tab 916 and first outer tab 918. The second inner tab 922 may be separated from the second outer tab 924 by a perforation, a score line, a reduced thickness portion, a weakened portion, or otherwise second severable line 930 that allows separation of the second inner tab 922 and second outer tab 924.

In at least one embodiment, the first severable line 928 allows separation of the first inner tab 916 and first outer tab 918 and also allows complete separation of the first outer tab 918 from the cover 902, while the second severable line 930 allows separation of the second inner tab 922 and second outer tab 924, but is configured to retain an attachment of the second outer tab 924 to the base 904 on both sides of the second outer tab 924. As a result, when the first and second interlocking flanges 910, 912 are fastened together, the container may be opened by separating the first and second inner tabs 916, 922 from the respective first and second outer tabs 918, 924, while the second outer tab 924 remains attached to the base 904, and the first outer tab 918 is separated from the cover and remains attached to the second outer tab 924.

Figure 12B:
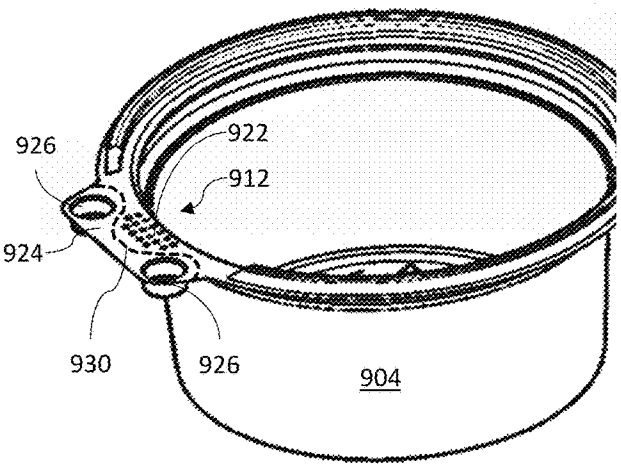
FIGS. 12A and 12B show an embodiment with first and second severable lines.
Figure 12A:
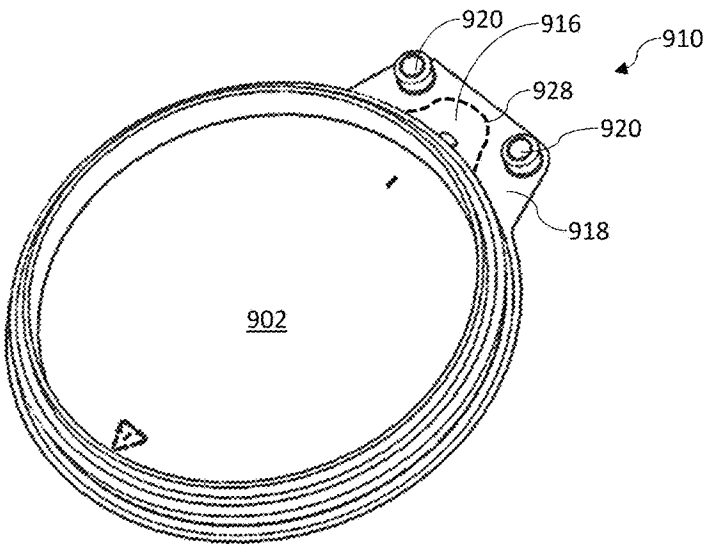

As shown in FIGS. 12A and 12B, in at least one other embodiment, the first severable line 928 allows separation of the first inner tab 916 and first outer tab 918, but is configured to retain an attachment of the first outer tab 918 to the cover 902 on both sides of the first outer tab, while the second severable line 930 allows separation of the second inner tab 922 and second outer tab 924 and also allows complete separation of the second outer tab 924 from the base 904. Therefore, when the first and second interlocking flanges 910, 912 are fastened together, the container may be opened by separating the first and second inner tabs 916, 922 from the respective first and second outer tabs 918, 924, while the first outer tab 918 remains attached to the cover 902, and the second outer tab 924 is separated from the base and remains attached to the first outer tab 918.

Figure 13A:
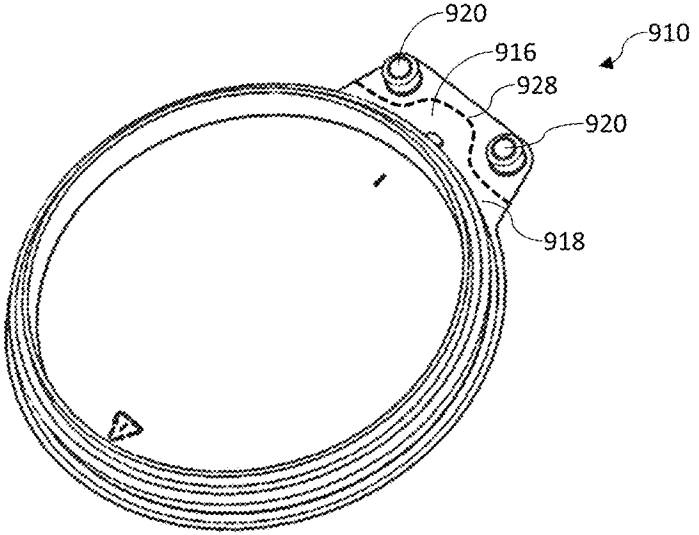
FIGS. 13A and 13B show another embodiment with first and second severable lines.
Figure 13B:
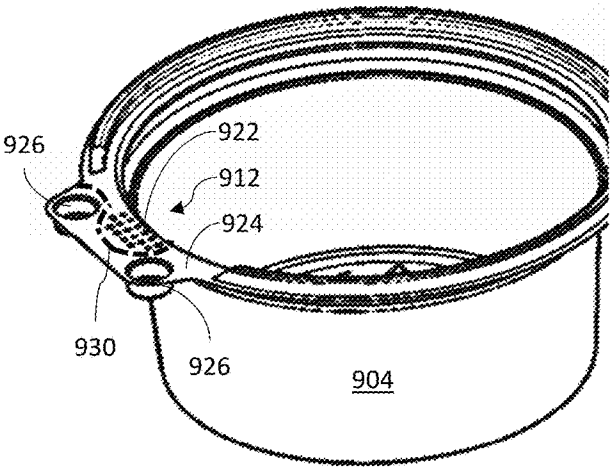

Another embodiment is illustrated in FIGS. 13A and 13B, where the first severable line 928 allows separation of the first inner tab 916 and first outer tab 918 and also allows complete separation of the first outer tab 918 from the cover 902, while the second severable line 930 allows a partial separation of the second inner tab 922 and second outer tab 924 and is configured to retain an attachment of the second outer tab 924 to the base 904 on one side of the second outer tab 924. As a result, when the first and second interlocking flanges 910, 912 are fastened together, the container may be opened by separating the first and second inner tabs 916, 922 from the respective first and second outer tabs 918, 924, while the second outer tab 924 is separated from the base 904 on one side and remains attached to the base 904 on another side, and the first outer tab 918 is separated from the cover and remains attached to the second outer tab 924.

Figure 14A:
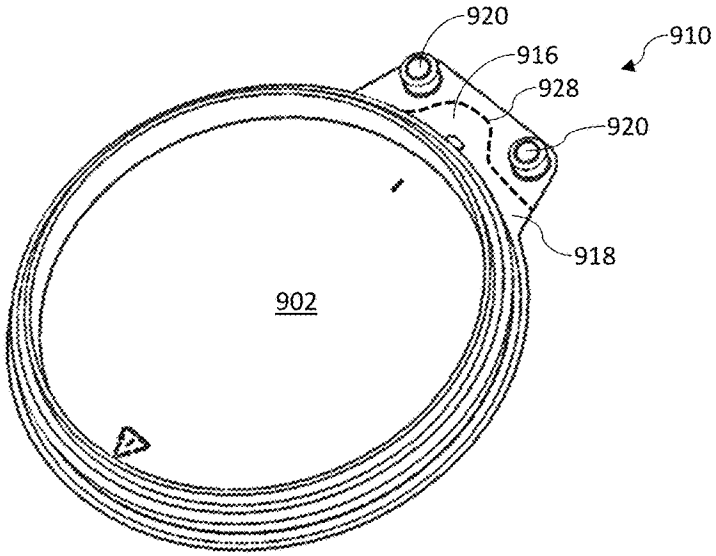
FIGS. 14A and 14B show yest another embodiment with first and second severable lines.
Figure 14B:
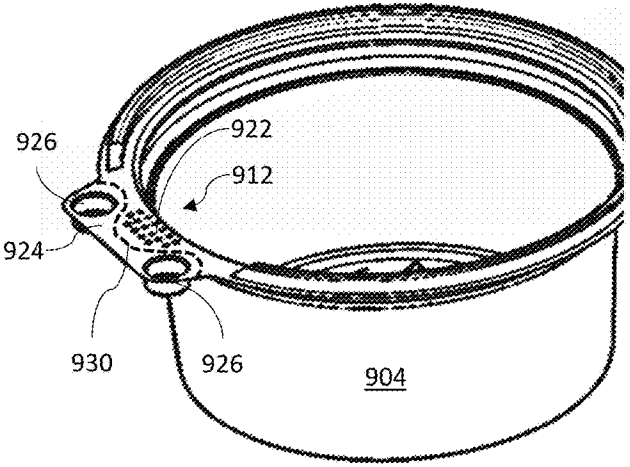

Yet another embodiment is shown in FIGS. 14A and 14B, where the first severable line 928 allows separation of the first inner tab 916 and first outer tab 918, but is configured to retain an attachment of the first outer tab 918 to the cover 902 on one side of the first outer tab, while the second severable line 930 allows separation of the second inner tab 922 and second outer tab 924 and also allows complete separation of the second outer tab 924 from the base 904. Therefore, when the first and second interlocking flanges 910, 912 are fastened together, the container may be opened by separating the first and second inner tabs 916, 922 from the respective first and second outer tabs 918, 924, while the first outer tab 918 is separated from the cover 902 on one side and remains attached to the cover 902 on another side, and the second outer tab 924 is separated from the base and remains attached to the first outer tab 918.

Figure 15:
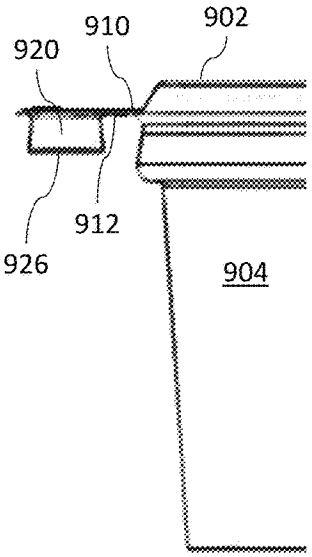
FIG. 15 illustrates first and second interlocking flanges fastened together.

FIG. 15 illustrates the first and second interlocking flanges 910, 912 fastened together. The male interlocking elements 920 and female interlocking elements 926 may have a fit, for example, an interference fit, such that when the male interlocking elements 920 and female interlocking elements 926 are fastened together, more force is required to separate the interlocking elements 920, 926 than to sever the first inner and outer tabs 916, 918 along the first severable line 928, and to sever the second inner and outer tabs 922, 924 along the second severable line 930.

Figure 16B:
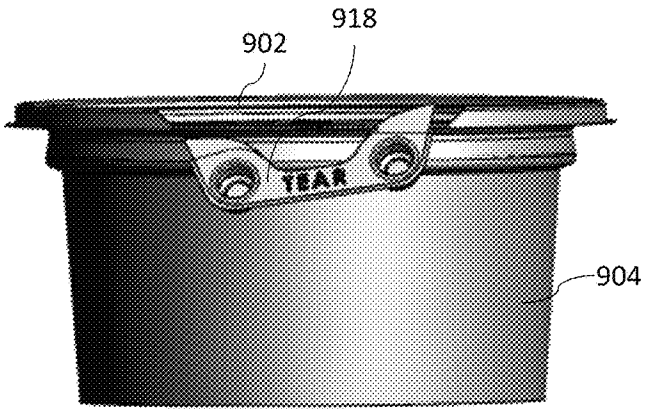
FIGS. 16A-16C show exemplary views of separated outer tabs.
Figure 16A:
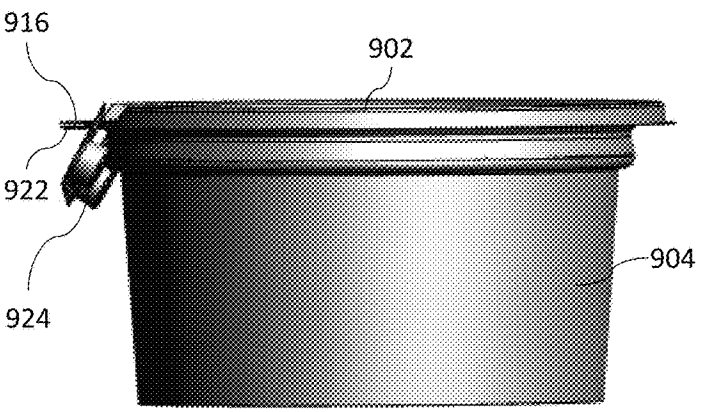
Figure 16C:
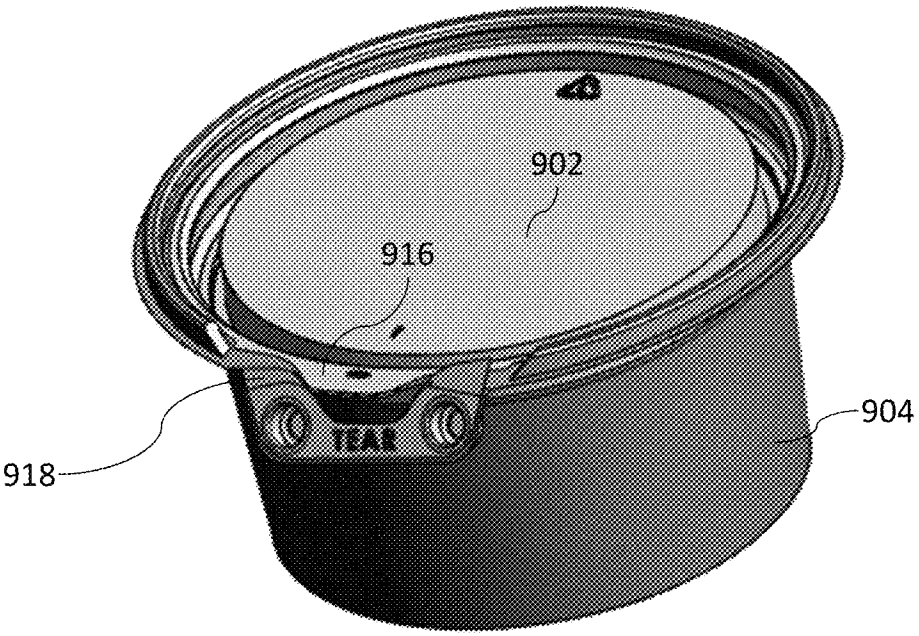

FIGS. 16A, 16B, and 16C show exemplary views of separated outer tabs where the second outer tab 924 is separated from the base 904 on one side and remains attached to the base 904 on another side, and the first outer tab 918 is completely separated from the cover 902 and remains attached to the second outer tab 924.

The disclosed embodiments allow for the use of various container configurations including hinged containers and containers with separate covers and bases. The interlocking flanges require significant force to separate over and above the force required to separate the inner and outer tabs along the first and second severable lines, providing an easily discernable indication that the container has been opened while also providing for retention of the interlocking flanges to, among other advantages, avoid scattering of loose portions of the packaging and allow recycling all the packaging material.

It is noted that the embodiments described herein can be used individually or in any combination thereof. It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

Various modifications and adaptations may become apparent to those skilled in the relevant arts in view of the foregoing description, when read in conjunction with the accompanying drawings. However, all such and similar modifications of the teachings of the disclosed embodiments will still fall within the scope of the disclosed embodiments.

Various features of the different embodiments described herein are interchangeable, one with the other. The various described features, as well as any known equivalents can be mixed and matched to construct additional embodiments and techniques in accordance with the principles of this disclosure.

Furthermore, some of the features of the exemplary embodiments could be used to advantage without the corresponding use of other features. As such, the foregoing description should be considered as merely illustrative of the principles of the disclosed embodiments and not in limitation thereof.

What is claimed is:

1. A tamper evident container comprising:

a cover comprising a first interlocking flange with a first inner tab and a first outer tab attached to the cover, the first inner and outer tabs separated by a first severable line; and a base comprising a second interlocking flange with a second inner tab and a second outer tab separated by a second severable line;

wherein the first and second interlocking flanges are configured to be fastened together and the container is configured to be opened by:

separating the first inner tab from the first outer tab along the first severable line while the first outer tab remains attached to the cover; and separating the second inner tab from the second outer tab along the second severable line while the second outer tab remains attached to the first outer tab.

2. The tamper evident container of claim 1, wherein the first outer tab remains attached to the cover of the container on one side of the first outer tab.

3. The tamper evident container of claim 1, wherein the first outer tab remains attached to the cover of the container on two sides of the first outer tab.

4. The tamper evident container of claim 1, further comprising a hinge connecting the cover and the base.

5. The tamper evident container of claim 1, wherein the cover and base comprise one or more of molded pulp fiber, high density polyethylene, polyethylene terephthalate, polystyrene, or polypropylene.

6. A method of providing a tamper evident container comprising:

forming a cover comprising a first interlocking flange with a first inner tab and a first outer tab attached to the cover, the first inner and outer tabs separated by a first severable line;

forming a base comprising a second interlocking flange with a second inner tab and a second outer tab separated by a second severable line;

wherein the first and second interlocking flanges are fastened together and the container is opened by:

separating the first inner tab from the first outer tab along the first severable line while the first outer tab remains attached to the cover; and separating the second inner tab from the second outer tab along the second severable line while the second outer tab remains attached to the first outer tab.

7. The method of claim 6, wherein the first outer tab remains attached to the cover of the container on one side of the first outer tab.

8. The method of claim 6, wherein the first outer tab remains attached to the cover of the container on two sides of the first outer tab.

9. The method of claim 6, further comprising connecting the cover and the base with a hinge.

10. The method of claim 6, comprising forming the cover and base from one or more of molded pulp fiber, high density polyethylene, polyethylene terephthalate, polystyrene, or polypropylene.

11. A tamper evident container comprising:

a cover comprising a first interlocking flange with a first inner tab and a first outer tab separated by a first severable line; and a base comprising a second interlocking flange with a second inner tab and a second outer tab attached to the base, the second inner and outer tabs separated by a second severable line;

wherein the first and second interlocking flanges are configured to be fastened together and the container is configured to be opened by:

separating the second inner tab from the second outer tab along the second severable line while the second outer tab remains attached to the base; and separating the first inner tab from the first outer tab along the first severable line while the first outer tab remains attached to the second outer tab.

12. The tamper evident container of claim 11, wherein the second outer tab remains attached to the base of the container on one side of the second outer tab.

13. The tamper evident container of claim 11, wherein the second outer tab remains attached to the base of the container on two sides of the second outer tab.

14. The tamper evident container of claim 11, further comprising a hinge connecting the cover and the base.

15. The tamper evident container of claim 11 wherein the cover and base comprise one or more of molded pulp fiber, high density polyethylene, polyethylene terephthalate, polystyrene, or polypropylene.

16. A method of providing a tamper evident container comprising:

forming a cover comprising a first interlocking flange with a first inner tab and a first outer tab separated by a first severable line;

forming a base comprising a second interlocking flange with a second inner tab and a second outer tab attached to the base, the second inner and outer tabs separated by a second severable line;

wherein the first and second interlocking flanges are fastened together and the container is opened by:

separating the second inner tab from the second outer tab along the second severable line while the second outer tab remains attached to the base; and separating the first inner tab from the first outer tab along the first severable line while the first outer tab remains attached to the second outer tab.

17. The method of claim 16, further comprising connecting the cover and the base with a hinge.

18. The method of claim 16, comprising forming the cover and base from one or more of molded pulp fiber, high density polyethylene, polyethylene terephthalate, polystyrene, or polypropylene.

19. The method of claim 16, wherein the second outer tab remains attached to the base of the container on one side of the second outer tab.

20. The method of claim 16, wherein the second outer tab remains attached to the base of the container on two sides of the second outer tab.

* * * * *